US006296263B1

(12) United States Patent
Schultz et al.

(10) Patent No.: US 6,296,263 B1
(45) Date of Patent: Oct. 2, 2001

(54) WHEELED TRIPLE LEG WALKER FOLDING TRAY

(76) Inventors: Theodore L. Schultz, 5010 Live Oak Cir., Bradenton, FL (US) 34207-2218; Margaret Ann Winney, 4107 52nd Street Ct., W., Bradenton, FL (US) 34209

( * ) Notice: Subject to any disclaimer, the term of this patent is extended or adjusted under 35 U.S.C. 154(b) by 0 days.

(21) Appl. No.: 09/643,226

(22) Filed: Aug. 22, 2000

(51) Int. Cl.[7] ..... A61H 3/00

(52) U.S. Cl. ..... 280/87.021; 135/67; 280/304.5; 280/42; 297/5

(58) Field of Search ..... 135/65, 67, 74, 135/85; 108/166, 170, 171, 173, 175; 297/5, 42, 44; 280/87.01, 87.021, 87.041, 42, 642, 304.1, 304.5

(56) References Cited

U.S. PATENT DOCUMENTS 484,240 * 10/1892 Rieckert ..... 297/44
2,316,100 * 4/1943 Nelson ..... 297/5 X
3,656,439 * 4/1972 Domin ..... 108/175
4,740,010 * 4/1988 Moskovitz ..... 108/170 X
5,131,547 * 7/1992 Goldberg ..... 108/166 X
5,273,063 * 12/1993 Farr et al. ..... 135/67 X
6,070,603 * 6/2000 Politz ..... 135/67

* cited by examiner

*Primary Examiner*—Michael Mar
(74) *Attorney, Agent, or Firm*—Frank A. Lukasik

(57) ABSTRACT

An improvement to a standard three wheeled walker to render it usable for carrying objects on a folding tray mounted between the vertical supports of the walker. A panel is split into two portions, which are pivotally joined together with a piano hinge. A "U" clamp having a mounting bracket and hinge is mounted on each vertical support. The hinges are attached to the bottom edges of the two split panels to attach the folding tray across the space between the two vertical supports. The tray folds upwardly when the walker is folded.

1 Claim, 4 Drawing Sheets

WHEELED TRIPLE LEG WALKER FOLDING TRAY

BACKGROUND OF THE INVENTION

1. Field of the Invention

The present invention relates generally to walking aids and more particularly to a walker equipped with a folding tray mounted between the two upper support members.

2. Discussion of the Prior Art

Of the many types of walkers available today, all require the use of two arms to control both stability of the person and forward movement, of the walker. because of the need for two arms to control the walker, the user must improvise if he/she needs to carry an object, such as, for example, an item purchased at a store. One possibility is to obtain a bag which has two handles, both of which are held with one hand against one of the upper members or is hung over the upper member. The instability of the package swinging to and fro could cause a fall or bumping into an object or person.

SUMMARY OF THE INVENTION

Accordingly, it is an object of the invention to provide a system for holding an item or package on a support member of a walker.

It is another object of the invention to provide a shelf suspended from vertical supports of a walker.

A still further object of the invention is to provide a folding shelf suspended from vertical supports of a walker.

The foregoing objects are realized in the present invention by providing a folding tray having hinges in the center and fastened to the upright supports of the walker with pipe "U" clamps. A bracket is fastened on each end of the tray. A pipe clamp, having a bracket fastened thereto, is fastened on each of the upright supports. The folding tray, which may be made of molded plastic, is formed with ridges on each of the forward end and the aft end of the tray to act as barriers to prevent objects from falling off. The ridges on the first side of the tray are extended to overlap the hinged joint to act as a stiffener to keep the folding tray from collapsing when a load is placed thereon. When the walker is folded, the folding tray is lifted upwardly to a point where the folding of the walker vertical supports continues folding the tray.

DESCRIPTION OF THE PREFERRED EMBODIMENT

Figure 1:
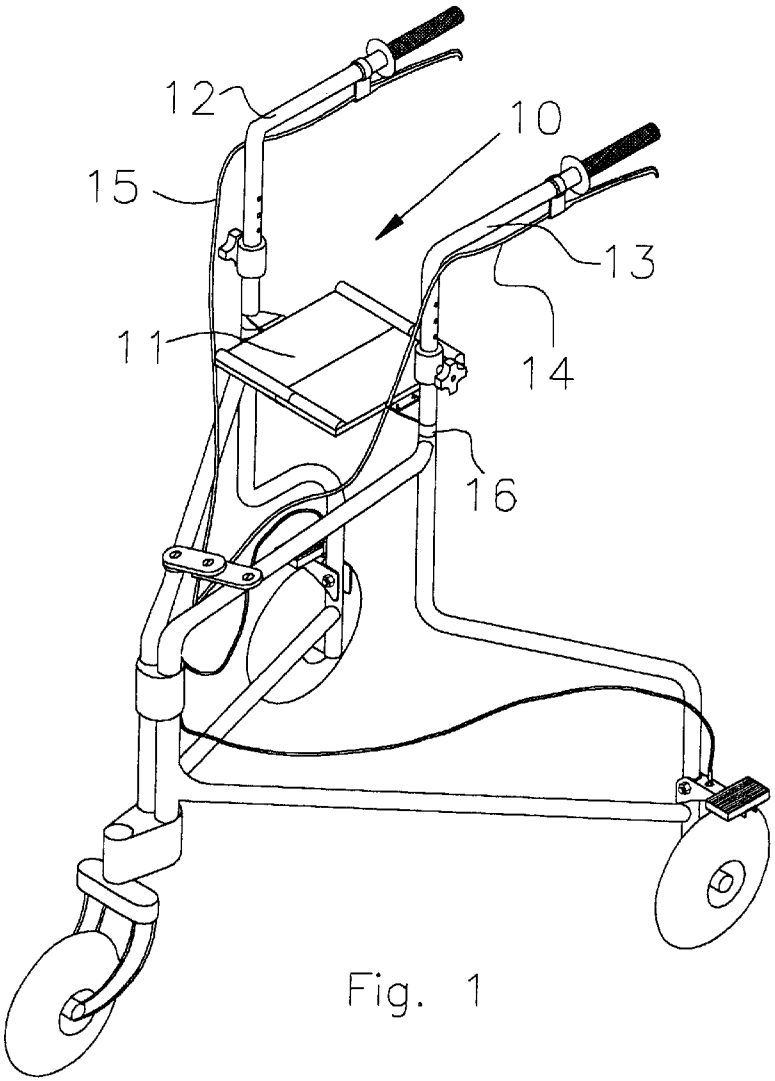
FIG. 1 is a top perspective, plan view of the folding tray mounted on a wheeled, triple leg walker in accordance with the invention.
Figure 2:
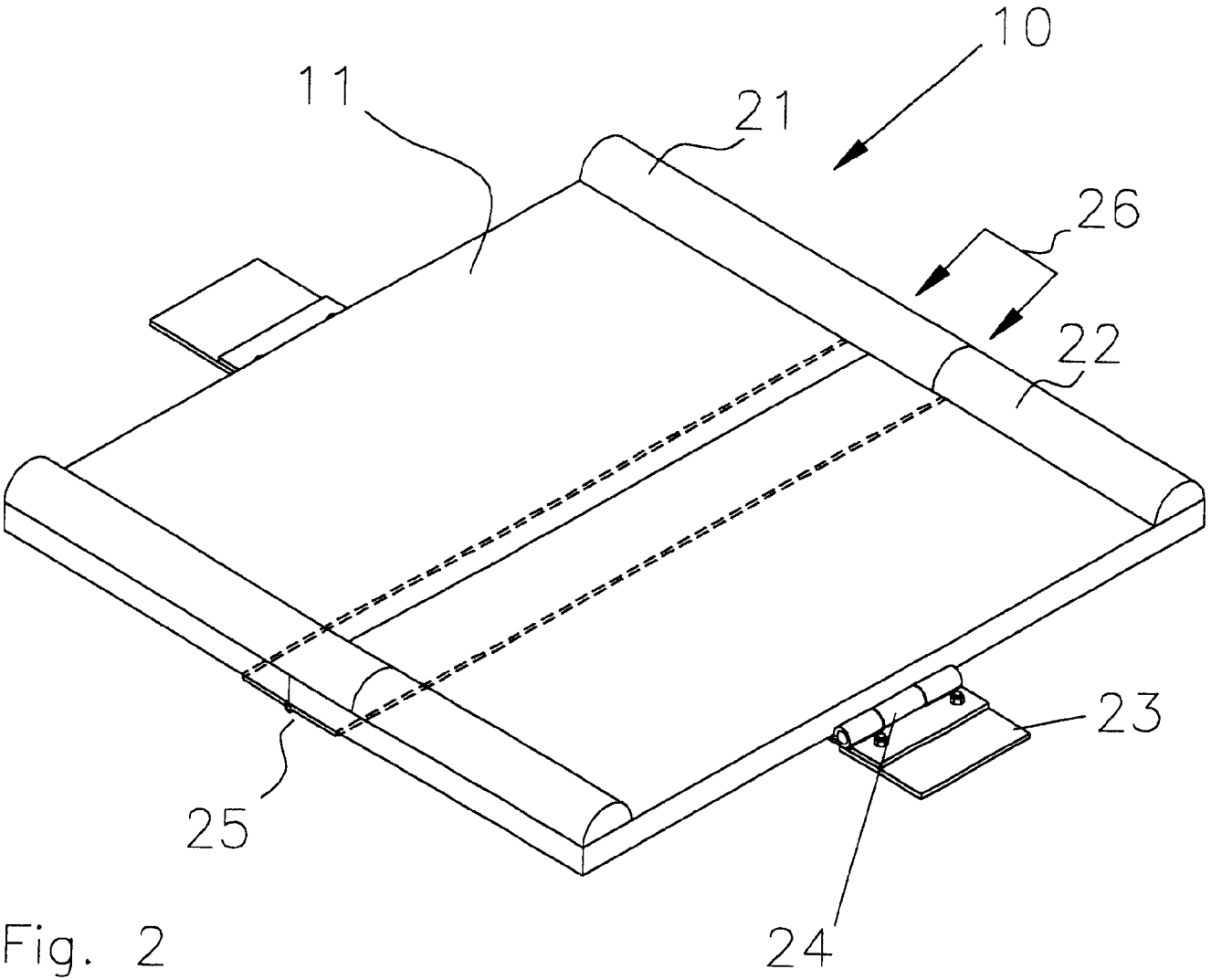
FIG. 2 is a top perspective, plan view of the folding tray in accordance with the invention.
Figure 3:
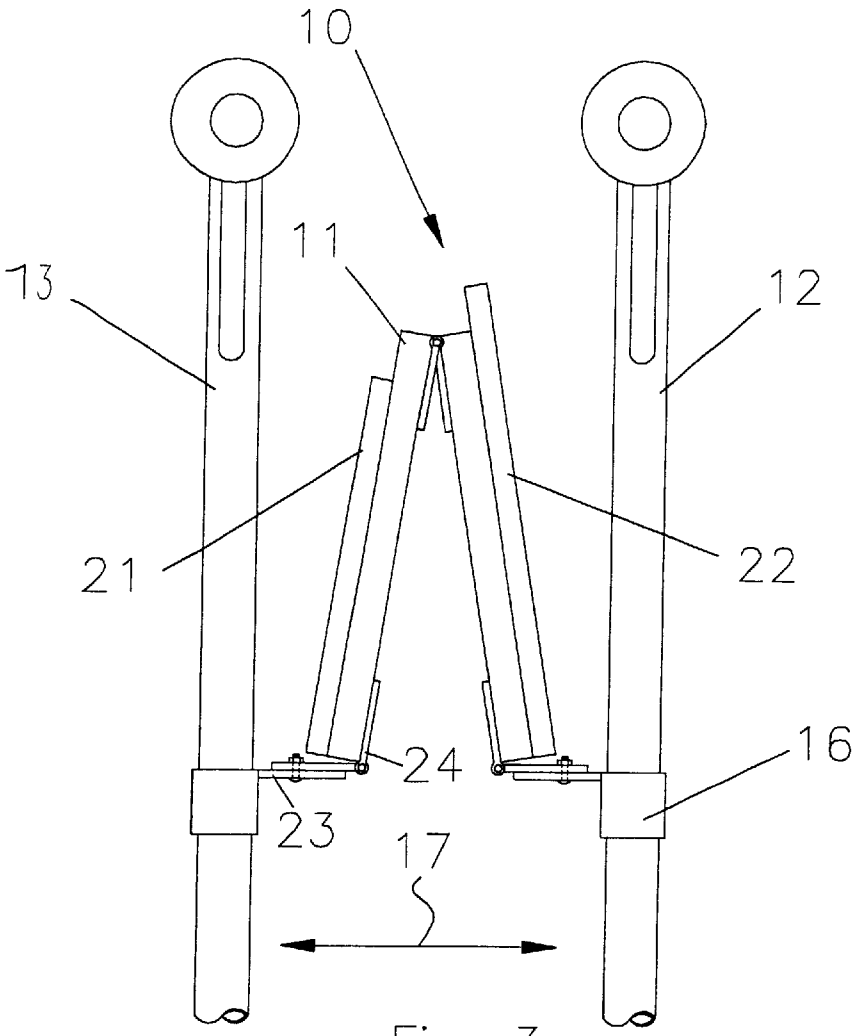
FIG. 3 is a front view of the folding tray of the invention in a folded position.
Figure 4:
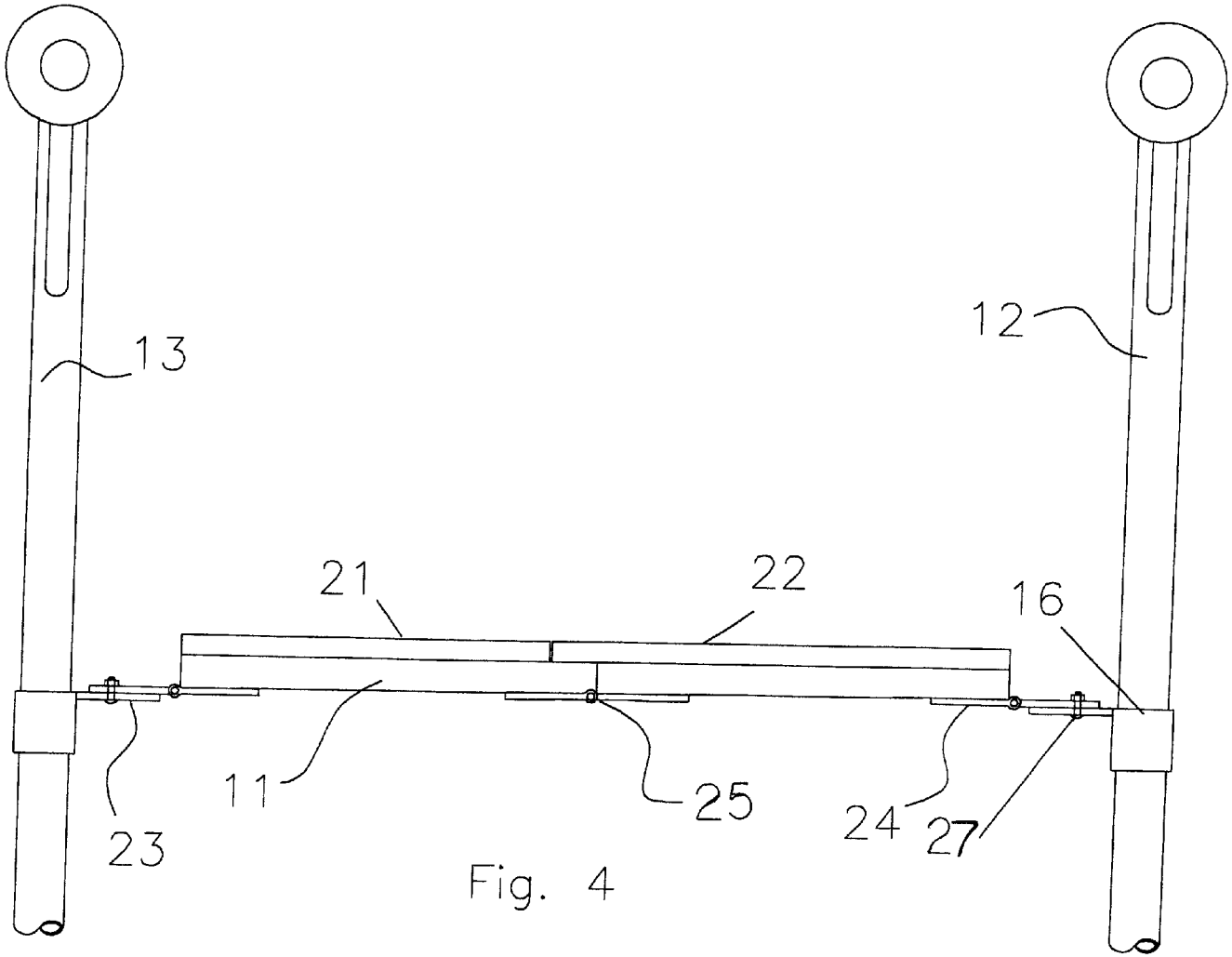
FIG. 4 is a front view of the folding tray of the invention in an an open position.

Referring to the drawings in detail, and referring first to FIGS. 1 and 4, there is illustrated the folding tray of the invention, designated by the numeral 10. The folding tray 10 is mounted between the vertical portions of the handlebars 12 and 13 of the walker. Folding tray 10 consists of panel 11, split into two halves, and joined together by piano hinge 25 fastened to the bottom sides of the two halves of panel 10. A single pipe "U" clamp 16 is mounted on each of the vertical portions of handlebars 12 and 13. A, bracket 23 is fastened to each of the clamps 16 and mounted to extend horizontally toward the center of the walker. A hinge 24 is mounted on each of the panel 11 edges and fastened to the brackets 23 of the clamp 16 with rivets or screws 27.

A first ridge 21, a short portion, and a second ridge 22, a long portion, are mounted or formed at the ends of panel 11. The second ridge 22 has a sufficient length to overlap the joint formed by hinge 25 to act as a stiffener to keep the folding tray 11 in an open position when a load is placed on the panel 11. The dotted lines indicated by numeral 26 show the relative position of the hinge 25 to the ends of the ridges 21 and 22.

The panel 11 may be made of plywood with the ridges 21 and 23 fastened with screws. The panel 11 may also be formed of molded plastic with the ridges formed during the molding process.

Of course, it should be understood that a wide range of changes and modifications can be made to the preferred embodiment described above. It is therefore, intended that the foregoing descriptions be regarded as illustrative rather than limiting, and that it can be understood that it is the following claims, including all equivalents, which are intended to define the scope of the invention.

What is claimed is:

1. A combination of a wheeled triple legged walker and a folding tray, said combination comprising:

a folding walker including first and second frame members, each frame member including a handlebar with a handgrip at a rearward end, a lower frame portion, and a vertical support member extending between a forward end of said handlebar and said lower frame portion, said lower frame portions having forward ends which are pivotally connected together to form a forward leg, a single wheel rotatably attached to said forward leg, and a pair of wheels attached to respective rearward legs of said lower frame portions;

a folding tray having a panel, said panel having a top surface and a bottom surface, a first side edge and a second side edge, a front edge and a back edge, said panel being split into a first half portion and a second half portion, a piano hinge being fastened to said bottom surface between said first and second half portions, thereby pivotally connecting said first and second half portions, first ridge members being formed on each of said front and back edges of said first half portion, and second ridge members being formed on each of said front and back edges of said second half portion, each of said second ridge members overlapping a portion of said first half portion when said first and second half portions are in an open, coplanar position; and a first pipe clamp being mounted on the vertical support member of said first frame member and a second pipe clamp being mounted on the vertical support member of said second frame member, each of said pipe clamps having a bracket extending horizontally and inwardly of said pipe clamps, and a hinge fastened to each of said brackets, said first side edge of said panel being fastened to said first pipe clamp hinge, and said second side edge of said panel being fastened to said second pipe clamp hinge, wherein said folding tray is pivotally connected between the vertical support members of said first and second frame members for movement between an open coplanar position when the walker is unfolded and a folded position with said first and second half portions overlapping when the walker is folded.

* * * * *